US009162274B2

(12) United States Patent
An et al.

(10) Patent No.: US 9,162,274 B2
(45) Date of Patent: Oct. 20, 2015

(54) DUAL DOUBLE-ACTION CAN BODY MAKER

(71) Applicant: Suzhou SLAC Precision Equipment Co.,Ltd., Suzhou, Jiangsu Province (CN)

(72) Inventors: Shu An, Jiangsu Province (CN); Bingsheng Wang, Jiangsu Province (CN); Lingguang Kong, Jiangsu Province (CN); Enquan Zhou, Jiangsu Province (CN)

(73) Assignee: Suzhou Slac Precision Equipment Co., Ltd. (CN)

( * ) Notice: Subject to any disclaimer, the term of this patent is extended or adjusted under 35 U.S.C. 154(b) by 199 days.

(21) Appl. No.: 13/690,682

(22) Filed: Nov. 30, 2012

(65) Prior Publication Data

US 2013/0216334 A1 Aug. 22, 2013

(30) Foreign Application Priority Data

Feb. 22, 2012 (CN) ..... 2012 1 0040629
Feb. 22, 2012 (CN) ..... 2012 2 0058258

(51) Int. Cl.
*B21D 22/28* (2006.01)
*B21D 51/26* (2006.01)

(52) U.S. Cl.
CPC ..... *B21D 22/28* (2013.01); *B21D 51/26* (2013.01)

(58) Field of Classification Search
USPC ..... 72/347–349, 450, 452.5, 379.4, 715; 413/69–77
See application file for complete search history.

(56) References Cited

U.S. PATENT DOCUMENTS 4,173,138 A * 11/1979 Main et al. ..... 72/349
4,546,636 A 10/1985 Snyder et al.
4,790,168 A * 12/1988 Vonthien ..... 72/389.6
4,996,865 A 3/1991 Haulsee et al.
5,335,532 A 8/1994 Mueller et al.
7,434,442 B2 * 10/2008 Gombas ..... 72/347

FOREIGN PATENT DOCUMENTS

CN 1030371 A 1/1989
CN 101888907 A 11/2010
CN 202427791 U 9/2012
GB 2292706 A 3/1996

OTHER PUBLICATIONS

Chinese Intellectual Property Office, International Search Report in corresponding International Application PCT/CN2012/075426, dated Dec. 6, 2012.

* cited by examiner

*Primary Examiner* — David B. Jones
*Assistant Examiner* — Pradeep C Battula
(74) *Attorney, Agent, or Firm* — Young Basile Hanlon & MacFarlane P.C.

(57) ABSTRACT

A dual double-action can body maker characterized in that a can body maker of the opposite way double-action structure is formed by way of a structural design of using two identical ram drive mechanisms and a design scheme of sharing one crankshaft. Two ram drive mechanisms share one crankshaft, and are arranged symmetrically to balance the inertial force of such parts as a swing lever. A slide yoke and a ram in motion and the reaction force generated in the can body redrawing and ironing process to reduce the load of the support bearing of the crankshaft and extend the service life.

7 Claims, 6 Drawing Sheets

DUAL DOUBLE-ACTION CAN BODY MAKER

CROSS-REFERENCE TO RELATED APPLICATIONS

This application claims priority from Chinese Patent Application No. 201220058258.3 and 201210040629.X, filed Feb. 22, 2012, which are incorporated herein by reference in their entirety.

The present disclosure relates to a can body maker apparatus, and especially to a dual double-action can body maker.

BACKGROUND

With the improvement of people's living standard, canned food and beverage are increasing, and the demand for the can is also growing.

The can is usually made of aluminum or steel, and composed of a can body and an easy-open end, where the can body is formed mostly by metal draw and iron. An existing can body maker is usually composed of a drawing die, a cup feed station, a can out conveyor, a cup hold down mechanism and a ram drive mechanism. The drawing die is used for drawing and ironing the can body, the cup feed station for transferring a can parison (a pre-drawn cup-shaped part) before it is drawn, the can out conveyor for discharging and outputting the can body after it is drawn, the cup hold down mechanism for tightly compressing the edge of the cup while drawing, and the ram drive mechanism for providing the ram stroke when the can body is drawn.

U.S. Pat. No. 4,173,138 discloses an disclosure patent titled Can Bodymaker Having Improved Ram Support and Drive, which relates to a can body maker, whose ram drive mechanism, as shown in FIGS. 1-3, comprises a crankshaft 14, a primary connecting rod 13, a swing lever 12, a secondary connecting rod 11, a hydrostatic guide rail 9, a slide yoke 10 and a ram 15; the primary connecting rod 13 is rotatably connected at one end with the throw of crankshaft 14, and at the other end with the swing arm of the swing lever 12; the swing lever 12 is rotatably supported at one end, and rotatably connected at the other end with one end of the secondary connecting rod 11, which is rotatably connected at the other end with the slide yoke 10 installed on the hydrostatic guide rail 9; the ram 15 is fixedly connected at one end with the slide yoke 10, and provided at the other with a punch used for drawing the can body. In the working condition, the crankshaft 14 is radially supported by a hydrodynamic journal bearing (not shown in the figure); while the can body is drawn, a motor drives the crankshaft 14 to rotate, the throw of crankshaft 14 drives the primary connecting rod 13 to move, which pushes the swing lever 12 to swing; the swing lever 12 drives the slide yoke 10 to slide along the hydrostatic guide rail 9 through the secondary connecting rod 11, thus driving the punch of the ram 15 to produce a ram stroke. Each time the crankshaft 14 rotates one circle, the punch of the ram 15 produces one ram stroke relative to the drawing die to draw out a can body, the process thus being continuously circulated to draw out the can body.

In the structural design of the can body maker of the above US patent, because only one ram drive mechanism is adopted for the one-way double-action body maker, the inertial force in motion and the reaction force generated by such parts as the swing lever 12, the slide yoke 10 and the ram 15, after the amplification of various transmission mechanisms, are finally entirely exerted on the main bearings supporting the crankshaft 14. Particularly when the crankshaft 14 works at a rotational speed of 400 rpm, these forces form a very big impact load on the main bearing. Therefore, as can be seen from the force analysis, the main bearing supporting the crankshaft 14 in this mechanical structure is the key of force balance and the weakness of the entire mechanism. A rolling bearing is difficult to withstand a greater impact load for a long time, a hydrodynamic journal bearing adopting a high-pressure oil supply system is needed.

For resolving the above problem of supporting the crankshaft in the ram drive mechanism, U.S. Pat. No. 5,546,785 titled Crankshaft Mechanism for Can Body Maker Apparatus provides a solution, i.e. a counterbalance-mass slide yoke is connected at a position contrary to the throw of crankshaft, and used for balancing the load exerted on the bearing by the inertial force of the mechanism itself (see the counterbalance-mass slide yoke 308 in FIG. 3 and the counterbalance-mass slide yoke 230 in FIG. 4 of the U.S. Pat. No. 5,546,785 for details). However, this solution can only balance the inertial force load exerted on the bearing generated by such motion parts as the swing lever 12, the slide yoke 10 and the ram 15 in motion, while the reaction force generated during the can body redrawing and ironing process cannot be balanced by the counterbalance-mass slide yoke. Besides, the addition of the counterbalance-mass block in the ram drive mechanism virtually increases the load of the drive motor, directly causing increase of the power consumption, causing waste of energy.

SUMMARY

The present disclosure provides a dual double-action can body maker, aiming to resolve the problems resulted from a series of unreasonable factors such as high design requirement, high processing difficulty, and short service life of the hydrodynamic journal bearing caused by the greater impact load exerted on the support main bearing of the crankshaft in a traditional one-way double-action can body maker.

In order to attain the above purpose, the present disclosure adopts a first technical solution as follows: A dual double-action can body maker comprising a ram drive mechanism is provided, innovative in the following aspects: the ram drive mechanism includes: a crankshaft, rotatably supported by a bearing, provided with a first throw of crankshaft and a second throw of crankshaft, the first throw of crankshaft having a turning direction contrary to the second throw of crankshaft in the radial direction of the crankshaft; two identical primary connecting rods, i.e. a first primary connecting rod and a second primary connecting rod; two identical swing levers, i.e. a first swing lever and a second swing lever; two identical secondary connecting rods, i.e. a first secondary connecting rod and a second secondary connecting rod; two identical guide rails, i.e. a first guide rail and a second guide rail; two identical slide yokes, i.e. a first slide yoke and a second slide yoke; and two identical rams, i.e. a first ram and a second ram.

The first primary connecting rod is rotatably connected at one end with the first throw of crankshaft, and at the other end with a swing arm of the first swing lever. The first swing lever is rotatably supported at one end, and rotatably connected at the other end with one end of the first secondary connecting rod, which is rotatably connected at the other end with the first slide yoke. The first slide yoke is installed on the first guide rail and connected slidingly relative to the first guide rail, which is fixed relative to the frame. And the first slide yoke is fixedly connected with the first ram.

The second primary connecting rod is rotatably connected at one end with the second throw of crankshaft, and at the other end with a swing arm of the second swing lever. The second swing lever is rotatably supported at one end, and rotatably connected at the other end with one end of the second secondary connecting rod, which is rotatably connected at the other end with the second slide yoke. The second slide yoke is installed on the second guide rail and connected slidingly relative to the second guide rail, which is fixed relative to the frame. And the second slide yoke is fixedly connected with the second ram.

The first throw of crankshaft, the first primary connecting rod, the first swing lever, the first secondary connecting rod, the first guide rail, the first slide yoke and the first ram are located at one side of the crankshaft, constituting a first ram drive mechanism. The second throw of crankshaft, the second primary connecting rod, the second swing lever, the second secondary connecting rod, the second guide rail, the second slide yoke and the second ram are located at the other side of the crankshaft, constituting a second ram drive mechanism.

In order to attain the above purpose, the present disclosure adopts a second technical solution as follows: A dual double-action can body maker comprising a ram drive mechanism is provided, innovative in the following aspects: the ram drive mechanism includes: a crankshaft, rotatably supported by a bearing, provided with a first throw of crankshaft, a second throw of crankshaft and a third throw of crankshaft that are sequentially arranged in the axial direction of the crankshaft, the first throw of crankshaft having a turning direction identical to the third throw of crankshaft and contrary to the second throw of crankshaft in the radial direction of the crankshaft; three primary connecting rods, i.e. a first primary connecting rod, a second primary connecting rod and a third primary connecting rod, the first primary connecting rod being identical to the third primary connecting rod; two identical swing levers, i.e. a first swing lever and a second swing lever; two identical secondary connecting rods, i.e. a first secondary connecting rod and a second secondary connecting rod; a two identical guide rails, i.e. a first guide rail and a second guide rail; two identical slide yokes, i.e. a first slide yoke and a second slide yoke; and two identical rams, i.e. a first ram and a second ram.

The first primary connecting rod is rotatably connected at one end with the first throw of crankshaft, and the third primary connecting rod is rotatably connected at one end with the third throw of crankshaft; the first primary connecting rod and the third primary connecting rod are coaxially rotatably connected at the other end with the swing arm of the first swing lever; the first swing lever is rotatably supported at one end, and rotatably connected at the other end with one end of the first secondary connecting rod, which is rotatably connected at the other end with the first slide yoke; the first slide yoke is installed on the first guide rail and connected slidingly relative to the first guide rail, which is fixed relative to the frame; and the first slide yoke is fixedly connected with the first ram.

The second primary connecting rod is rotatably connected at one end with the second throw of crankshaft, and at the other end with a swing arm of the second swing lever; the second swing lever is rotatably supported at one end, and rotatably connected at the other end with one end of the second secondary connecting rod, which is rotatably connected at the other end with the second slide yoke; the second slide yoke is installed on the second guide rail and connected slidingly relative to the second guide rail, which is fixed relative to the frame; and the second slide yoke is fixedly connected with the second ram.

The first throw of crankshaft, the third throw of crankshaft, the first primary connecting rod, the third primary connecting rod, the first swing lever, the first secondary connecting rod, the first guide rail, the first slide yoke and the first ram are located at one side of the crankshaft, constituting a first ram drive mechanism; the second throw of crankshaft, the second primary connecting rod, the second swing lever, the second secondary connecting rod, the second guide rail, the second slide yoke and the second ram are located at the other side of the crankshaft, constituting a second ram drive mechanism.

The design principle of the present disclosure is as follows: A dual double-action can body maker is formed by means use of a structural design of using two identical ram drive mechanisms and a design scheme of sharing one crankshaft. The solutions make the two ram drive mechanisms share one crankshaft, and then symmetrically constitute the double-action structure in the two opposite directions.

With application of the above technical solutions, the present disclosure has the following advantages and effects: First, it makes the two identical ram drive mechanisms share one crankshaft and arranged in the opposite direction. When the two ram drive mechanisms work at the same time, they can balance the inertial force of such parts as the swing lever, the slide yoke and the ram in motion and the reaction force generated in the can body redrawing and ironing process, thus significantly reducing the load of the support bearing of the crankshaft. After analysis by the simulation software, the maximum impact load of the support bearing of the crankshaft when the traditional one-way can body maker works is about 76,000N, while the maximum impact load of the design of the present disclosure under the equivalent conditions is only about 40,000N, which is reduced by more than about 40%. This change not only lowers the design and manufacture requirements of the support main bearing of the crankshaft, but also extends service life of the bearing, reducing the use and maintenance expenses.

Second, two ram drive mechanisms, two drawing dies, two cup hold down mechanisms, two cup feed stations and/or two can out conveyors allow productivity of two traditional can body makers to be achieved under the drive of one main motor.

Third, because the inertial force of such parts as the swing lever, the slide yoke and the ram in motion and the reaction force generated in the can body redrawing and ironing process are balanced, one can body maker of the present disclosure significantly reduces the energy consumption compared with two traditional can body makers for the same productivity.

Fourth, because one can body maker of the present disclosure is equivalent to two traditional can body makers, the area occupied by the machine is significantly smaller than that occupied by two apparatus, improving the utilization rate of the factory building.

Fifth, because the present disclosure adopts the solution that two ram drive mechanisms share one crankshaft, one flywheel and one drive motor, one drive apparatus is saved compared to the two traditional can body makers, significantly reducing manufacturing cost of the apparatus.

These and other aspects and implementations will be described in additional detail hereafter.

BRIEF DESCRIPTION OF THE DRAWINGS

The description herein makes reference to the accompanying drawings wherein like reference numerals refer to like parts throughout the several views, and wherein.

In the above drawings: 1. Frame; 2. cup feed station; 3. cup feed drive motor; 4. can out conveyor; 5. can out conveyor drive motor; 6. can out conveyor chain; 7. cup hold down mechanism; 8. ram hydrostatic bearing; 9. guide rail; 10. slide yoke; 11. secondary connecting rod; 12. swing lever; 13. primary connecting rod; 14. crankshaft; 15. ram; 16. die; 17. stripper ring; 18. support arm; 19. dome die; 20. drive box; 21. drive motor; 22. flywheel; 23. lubricating oil heat exchanger; 24. lubricating oil filtering system; 25. lubricating oil supply pump; and 26. hydrodynamic journal bearing and hydrostatic bearing oil supply pump.

DETAILED DESCRIPTION

The present disclosure will further be described below with reference to the drawings and examples.

Example 1

A Dual Double-Action Can Body Maker

Figure 1:
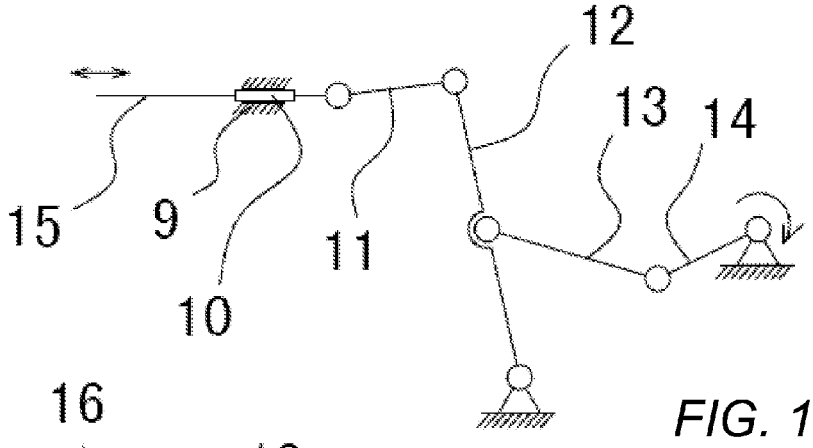
FIG. 1 is a drawing of principle of the ram drive mechanism of the traditional can body maker.
Figure 2:
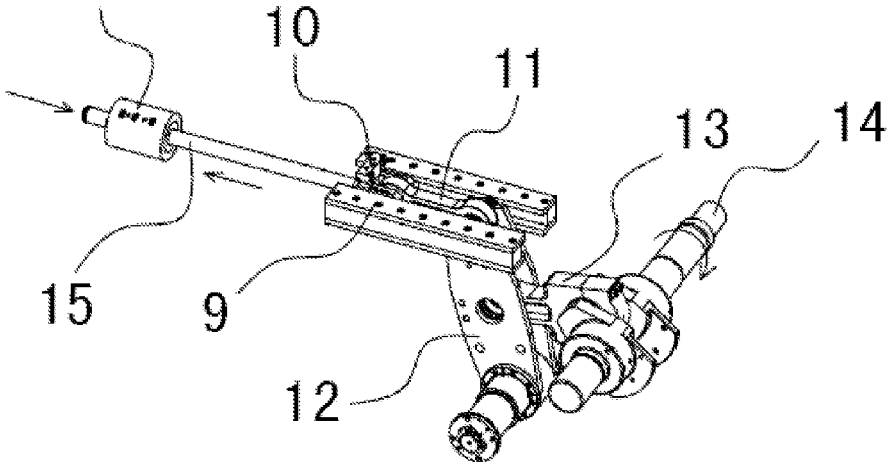
FIG. 2 is an isometric view of the ram drive mechanism of the traditional can body maker in a drawn state.
Figure 3:
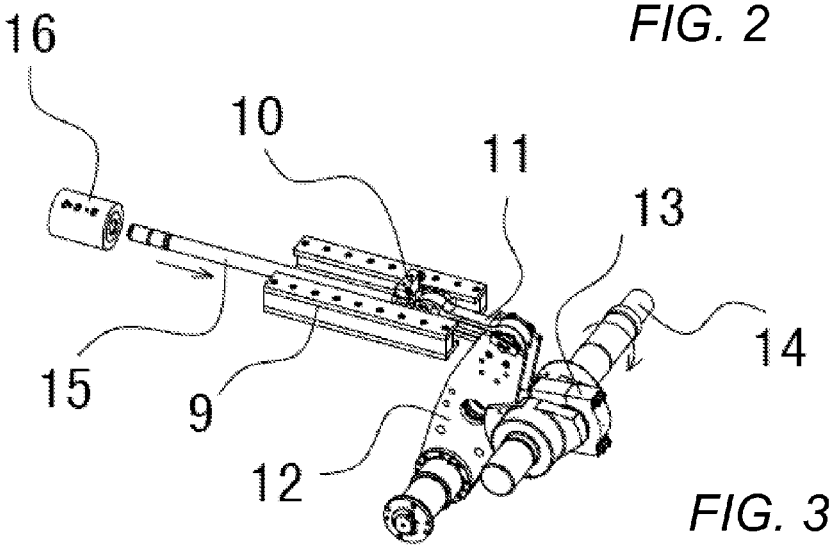
FIG. 3 is an isometric view of the ram drive mechanism of the traditional can body maker in a back stroke state.
Figure 4:
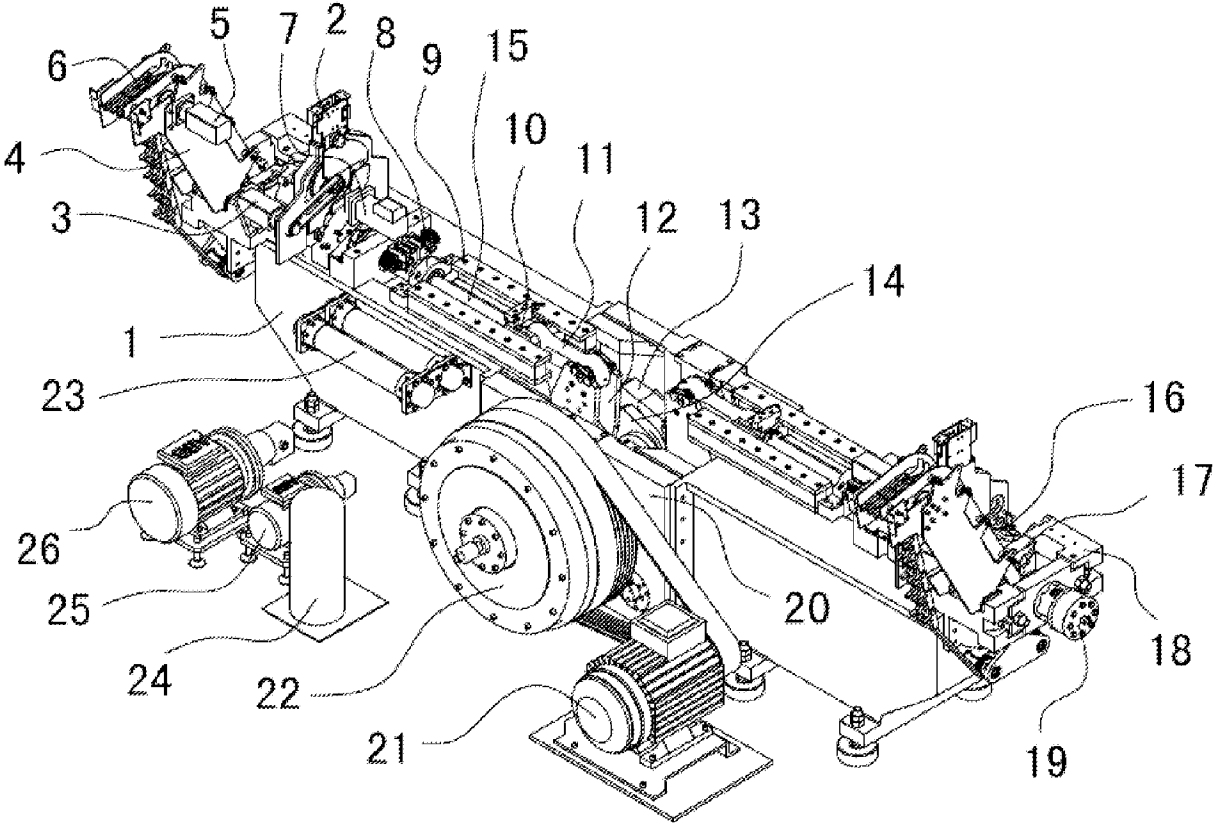
FIG. 4 is an isometric view of the dual double-action can body maker of the present disclosure.

As shown in FIG. 4, this can body maker comprises a frame 1, two dies 16, two cup hold down mechanisms 7, two cup feed stations 2, two can out conveyors 4, and two ram drive mechanisms.

Figure 5:
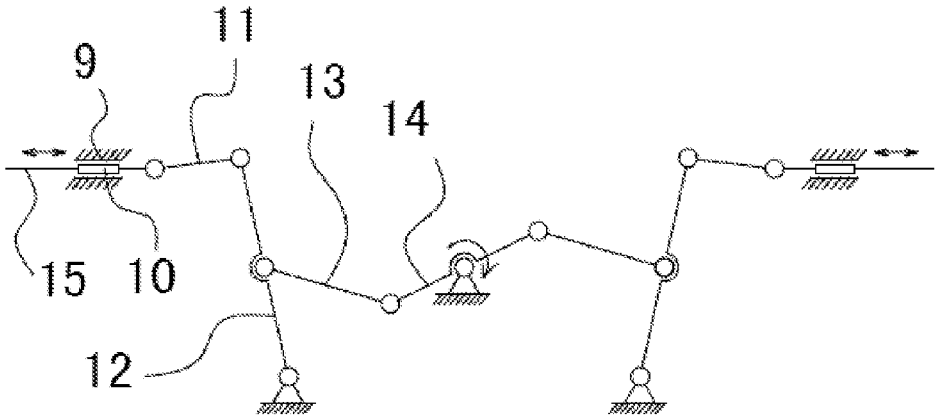
FIG. 5 is a drawing of principle of the ram drive mechanism of the present disclosure in the first layout.
Figure 6:
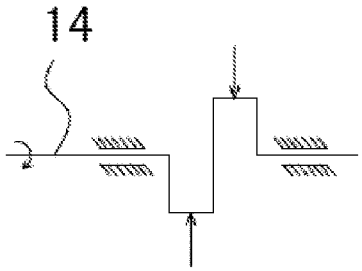
FIG. 6 is a drawing of principle of the two-throw crankshaft of the present disclosure.
Figure 7:
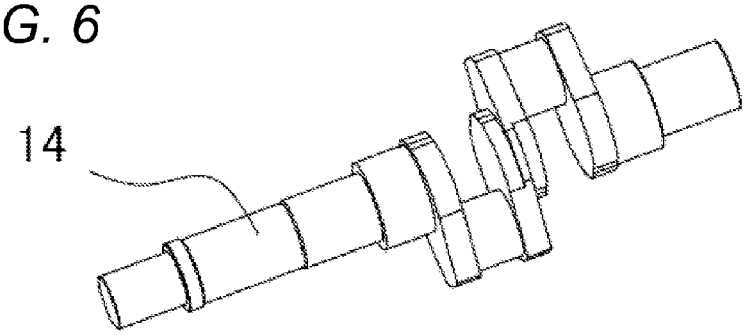
FIG. 7 is an isometric view of the two-throw crankshaft of the present disclosure.
Figure 8:
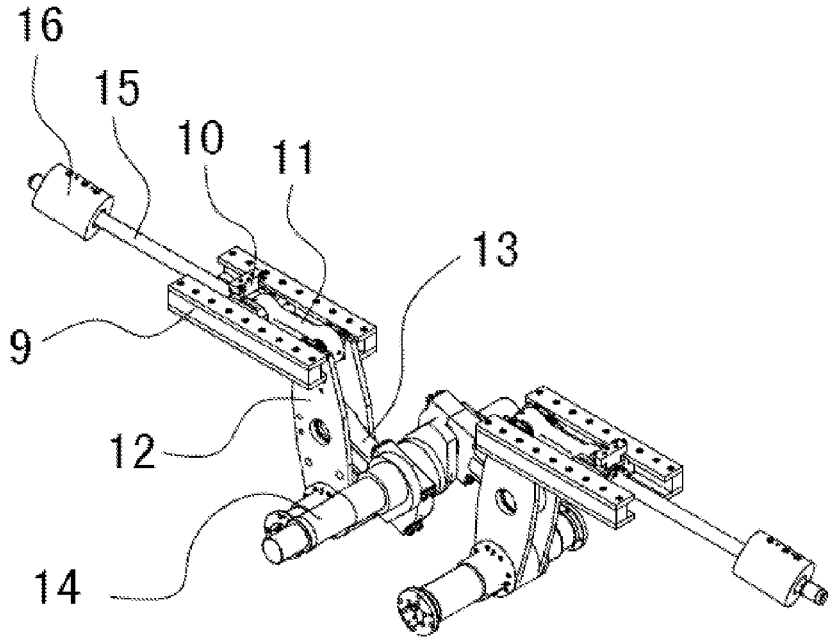
FIG. 8 is an isometric view of the ram drive mechanism of the present disclosure adopting the first layout and two-throw crankshaft.

As shown in FIGS. 5 and 8, the ram drive mechanism comprises the following structures:

a crankshaft 14, rotatably supported by a bearing that is a hydrodynamic journal bearing, provided with a first throw of crankshaft and a second throw of crankshaft (see FIGS. 6 and 7), the first throw of crankshaft having a turning direction contrary to the second throw of crankshaft in the radial direction of the crankshaft 14;

two identical primary connecting rods 13, i.e. a first primary connecting rod and a second primary connecting rod;

two identical swing levers 12, i.e. a first swing lever and a second swing lever;

two identical secondary connecting rods 11, i.e. a first secondary connecting rod and a second secondary connecting rod;

two identical guide rails 9, i.e. a first guide rail and a second guide rail;

two identical slide yokes 10, i.e. a first slide yoke and a second slide yoke;

two identical rams 15, i.e. a first ram and a second ram;

a flywheel 22 (see FIG. 4), provided at one end with a clutch brake; and a drive motor 21 (see FIG. 4), used for driving the ram drive mechanism.

Each part of the ram drive mechanism has the following connection relation. First, the drive motor 21 is in transmission connection through a belt with the flywheel 22 (see FIG. 4), which is in transmission connection with the crankshaft 14 through the clutch-brake at one end.

Second, the first primary connecting rod is rotatably connected at one end with the first throw of crankshaft on the crankshaft 14, and at the other end with the swing arm of the first swing lever; the first swing lever is rotatably supported at one end, and rotatably connected at the other end with one end of the first secondary connecting rod, which is rotatably connected at the other end with the first slide yoke; the first slide yoke is installed on the first guide rail and connected slidingly relative to the first guide rail, which is fixed relative to the frame; and the first slide yoke is fixedly connected with the first ram.

Third, the second primary connecting rod is rotatably connected at one end with the second throw of crankshaft on the crankshaft 14, and at the other end with the swing arm of the second swing lever; the second swing lever is rotatably supported at one end, and rotatably connected at the other end with one end of the second secondary connecting rod, which is rotatably connected at the other end with the second slide yoke; the second slide yoke is installed on the second guide rail and connected slidingly relative to the second guide rail, which is fixed relative to the frame; and the second slide yoke is fixedly connected with the second ram.

Fourth, the first throw of crankshaft, the first primary connecting rod, the first swing lever, the first secondary connecting rod, the first guide rail, the first slide yoke and the first ram are located at one side of the crankshaft 14, constituting a first ram drive mechanism. The second throw of crankshaft, the second primary connecting rod, the second swing lever, the second secondary connecting rod, the second guide rail, the second slide yoke and the second ram are located at the other side of the crankshaft 14, constituting a second ram drive mechanism. A rotation support point of the first swing lever and a rotation support point of the second swing lever are arranged in a cross-sectional plane of the crankshaft 14 and symmetrically about a vertical line through a rotation central point of the crankshaft 14; that is, as shown in FIG. 5, the first ram drive mechanism and the second ram drive mechanism are arranged symmetrically about a vertical line through the rotation central point of the crankshaft 14, thus forming the first layout as shown in FIG. 5. Because the first ram drive mechanism and the second ram drive mechanism share one crankshaft 14 and are arranged in the opposite direction, when the two ram drive mechanisms work at the same time, they can balance the inertial force of such parts as the swing lever, the slide yoke and the ram in motion and the reaction force generated in the can body redrawing and ironing process, thus significantly reducing the load of the support main bearing of the crankshaft 14.

Figure 9:
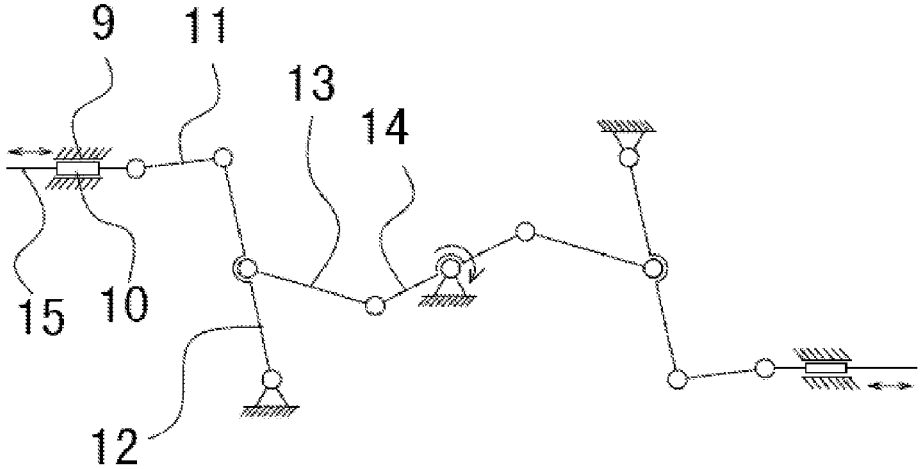
FIG. 9 is a drawing of principle of the ram drive mechanism of the present disclosure in the second layout.

In Example 1, the first ram drive mechanism and the second ram drive mechanism can also be designed to be in the second layout as shown in FIG. 9 in addition to the first layout as shown in FIG. 5. The second layout is characterized in that the rotation support point of the first swing lever and the rotation support point of the second swing lever are arranged in the cross-sectional plane of the crankshaft 14 and symmetrically about the rotation central point of the crankshaft 14. It can be seen from comparison of FIG. 9 with FIG. 5 that the second layout is better than the first layout in balancing the inertial force of such parts as the swing lever, the slide yoke and the ram in motion and the reaction force generated in the can body redrawing and ironing process, because this arrangement balances not only the force on the bearing in the movement direction of the ram, but also the force on the bearing perpendicular to the ground, thus making the entire apparatus have smaller vibration and run more steadily.

In Example 1, in addition to the above ram drive mechanism, the dual double-action can body maker have to be further provided with two dies 16, two cup hold down mechanisms 7, two cup feed stations 2, and two can out conveyors (see FIG. 4). The two dies 16 form the dual double-action can body maker structure together with the two identical rams 15. The die 16, as a can body drawing die, is mainly composed of the punch at the end of the ram 15, the drawing die and the dome die 19. This part can adopt the existing technology, such as the technical solution disclosed by the U.S. Pat. No. 3,735,629. For ensuring stability of the ram 15, a ram hydrostatic bearing 8 can be sleeved on the ram 15 (see FIG. 4). The cup hold down mechanism 7 is used for tightly compressing the edge of the cup while redrawing, and can use the technical solution disclosed by the U.S. Pat. No. 3,704,619. The cup feed station 2 is used for transferring the cup before it is drawn, and driven by the cup feed drive motor 3. The cup feed station 2 can adopt the technical solution disclosed by the U.S. Pat. No. 5,566,567. The can out conveyor 4 is used for discharging and outputting the can body after it is drawn, and composed of such parts as a stripper ring 17, a can out conveyor chain 6, and a can out conveyor drive motor 5. The stripper ring 17 can adopt the technical solution disclosed by the U.S. Pat. No. 3,664,171. The can out conveyor 4 and the dome die 19 are supported by the support arm 18. Besides, the dual double-action can body maker is further provided with such auxiliary systems as a lubricating oil heat exchanger 23, a lubricating oil filtering system 24, a lubricating oil supply pump 25, and a hydrodynamic journal bearing and hydrostatic bearing oil supply pump 26.

Example 2

A Dual Double-Action Can Body Maker

As shown in FIG. 4, this can body maker comprises a frame 1, two dies 16, two cup hold down mechanisms 7, two cup feed stations 2, two can out conveyors 4, and two ram drive mechanisms.

Figure 10:
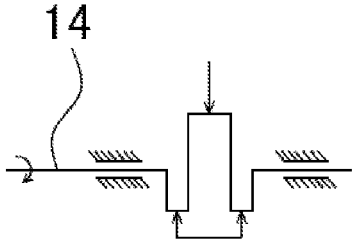
FIG. 10 is a drawing of principle of the three-throw crankshaft of the present disclosure.
Figure 11:
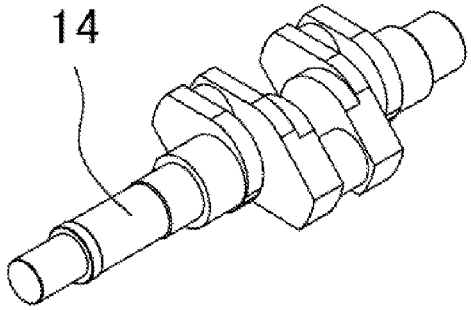
FIG. 11 is an isometric view of the three-throw crankshaft of the present disclosure.
Figure 12:
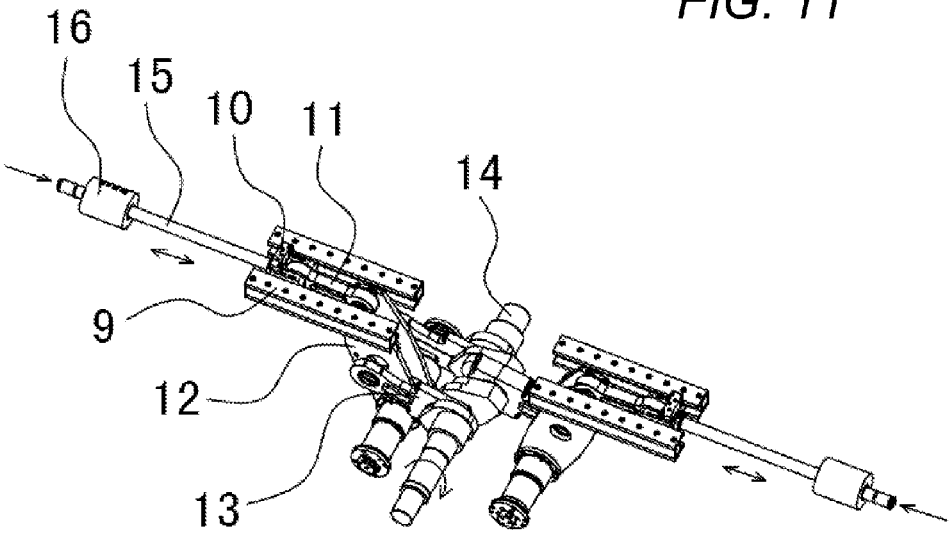
FIG. 12 is an isometric view of the ram drive mechanism of the present disclosure adopting the first layout and three-throw crankshaft.

It is different from Example 1 in the following aspects: the crankshaft 14 in the ram drive mechanism comprises three crankshafts, and has three primary connecting rods 13. As shown in FIGS. 5 and 12, the ram drive mechanism comprises the following structures:

a crankshaft 14, rotatably supported by a bearing, provided with a first throw of crankshaft, a second throw of crankshaft and a third throw of crankshaft (see FIGS. 10 and 11) that are sequentially arranged in the axial direction of the crankshaft 14, the first throw of crankshaft having a turning direction identical to the third throw of crankshaft and contrary to the second throw of crankshaft in the radial direction of the crankshaft 14;

three primary connecting rods 13, i.e. a first primary connecting rod, a second primary connecting rod and a third primary connecting rod, the first primary connecting rod being identical to the third primary connecting rod;

two identical swing levers 12, i.e. a first swing lever and a second swing lever; two identical secondary connecting rods 11, i.e. a first secondary connecting rod and a second secondary connecting rod;

two identical guide rails 9, i.e. a first guide rail and a second guide rail;

two identical slide yokes 10, i.e. a first slide yoke and a second slide yoke;

two identical rams 15, i.e. a first ram and a second ram;

a flywheel 22 (see FIG. 4), provided at one end with a clutch-brake; and a drive motor 21 (see FIG. 4), used for driving the ram drive mechanism.

Each part of the ram drive mechanism has the following connection relation. First, the drive motor 21 is in transmission connection through a belt with the flywheel 22 (see FIG. 4), which is in transmission connection with the crankshaft 14 through the clutch-brake at one end.

Second, the first primary connecting rod is rotatably connected at one end with the first throw of crankshaft, and the third primary connecting rod is rotatably connected at one end with the third throw of crankshaft; the first primary connecting rod and the third primary connecting rod are coaxially rotatably connected at the other end with the swing arm of the first swing lever; the first swing lever is rotatably supported at one end, and rotatably connected at the other end with one end of the first secondary connecting rod, which is rotatably connected at the other end with the first slide yoke; the first slide yoke is installed on the first guide rail and connected slidingly relative to the first guide rail, which is fixed relative to the frame; and the first slide yoke is fixedly connected with the first ram.

Third, the second primary connecting rod is rotatably connected at one end with the second throw of crankshaft, and at the other end with the swing arm of the second swing lever; the second swing lever is rotatably supported at one end, and rotatably connected at the other end with one end of the second secondary connecting rod, which is rotatably connected at the other end with the second slide yoke; the second slide yoke is installed on the second guide rail and connected slidingly relative to the second guide rail, which is fixed relative to the frame; and the second slide yoke is fixedly connected with the second ram.

Figure 13:
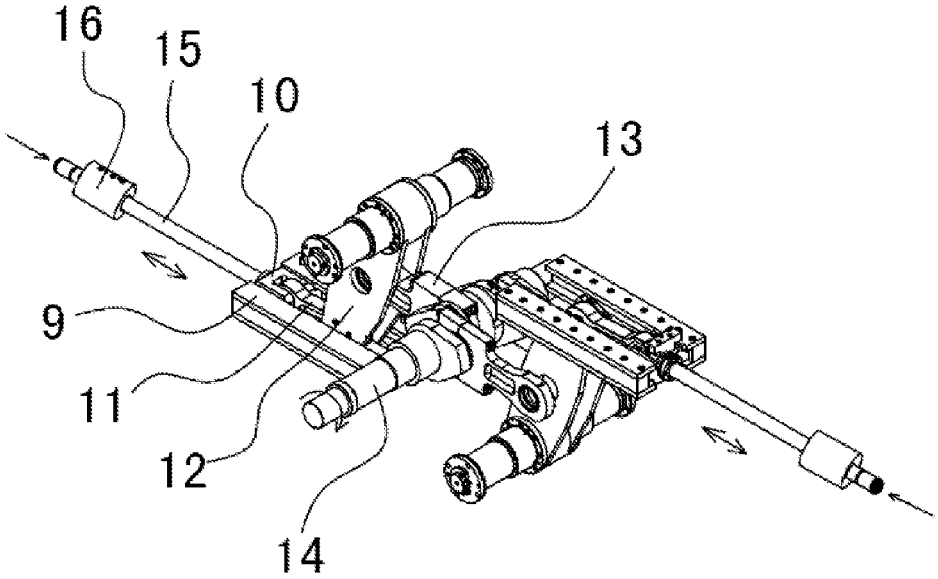
FIG. 13 is an isometric view of the ram drive mechanism of the present disclosure adopting the second layout and three-throw crankshaft.

Fourth, the first throw of crankshaft, the third throw of crankshaft, the first primary connecting rod, the third primary connecting rod, the first swing lever, the first secondary connecting rod, the first guide rail, the first slide yoke and the first ram are located at one side of the crankshaft 14, constituting a first ram drive mechanism; the second throw of crankshaft, the second primary connecting rod, the second swing lever, the second secondary connecting rod, the second guide rail, the second slide yoke and the second ram are located at the other side of the crankshaft 14, constituting a second ram drive mechanism. The rotation support point of the first swing lever and the rotation support point of the second swing lever are arranged in a cross-sectional plane of the crankshaft 14 and symmetrically about a vertical line through the rotation central point of the crankshaft 14; that is, as shown in FIG. 5, the first ram drive mechanism and the second ram drive mechanism are arranged symmetrically about a vertical line through the rotation central point of the crankshaft 14, thus forming the first layout as shown in FIG. 5. They can also be designed to be in the second layout as shown in FIG. 9 in addition to the first layout as shown in FIG. 5, with the specific structure as shown in FIG. 13; that is, the rotation support point of the first swing lever and the rotation support point of the second swing lever are arranged in the cross-sectional plane of the crankshaft 14 and symmetrically about the rotation central point of the crankshaft 14.

Other structures are similar to Example 1, and will not be described again here.

The above implementations are used only for explaining the technical concept and characteristics of the present disclosure. They are provided to make those skilled in the art understand the present disclosure and implement it, rather than limit the scope of protection of the present disclosure. All equivalent alterations or modifications according to the spirit of the present disclosure shall fall within the scope of protection of the present disclosure.

What is claimed is:

1. A dual double-action can body maker comprising:

a ram drive mechanism including:

a crankshaft rotatably supported by a bearing, provided with a first throw of crankshaft and a second throw of crankshaft, the first throw of crankshaft having a turning direction contrary to the second throw of crankshaft in a radial direction of the crankshaft;

a first primary connecting rod and a second primary connecting rod;

a first swing lever and a second swing lever;

a first secondary connecting rod and a second secondary connecting rod;

a first guide rail and a second guide rail;

a first slide yoke and a second slide yoke; and a first ram and a second ram;

wherein:

the first primary connecting rod is rotatably connected at one end with the first throw of crankshaft, and at an opposite end with a swing arm of the first swing lever; the first swing lever is rotatably supported at one end, and rotatably connected at an opposite end with one end of the first secondary connecting rod, which is rotatably connected at an opposite end with the first slide yoke; the first slide yoke is installed on the first guide rail and connected slidingly relative to the first guide rail, which is fixed relative to a frame; and the first slide yoke is fixedly connected with the first ram;

the second primary connecting rod is rotatably connected at one end with the second throw of crankshaft, and at an opposite end with a swing arm of the second swing lever; the second swing lever is rotatably supported at one end, and rotatably connected at an opposite end with one end of the second secondary connecting rod, which is rotatably connected at an opposite end with the second slide yoke; the second slide yoke is installed on the second guide rail and connected slidingly relative to the second guide rail, which is fixed relative to the frame; and the second slide yoke is fixedly connected with the second ram; and the first throw of crankshaft, the first primary connecting rod, the first swing lever, the first secondary connecting rod, the first guide rail, the first slide yoke and the first ram are located at one side of the crankshaft, constituting a first ram drive mechanism; the second throw of crankshaft, the second primary connecting rod, the second swing lever, the second secondary connecting rod, the second guide rail, the second slide yoke and the second ram are located at an opposite side of the crankshaft, constituting a second ram drive mechanism.

2. The dual double-action can body maker according to claim 1, comprising:

the crankshaft provided with a third throw of crankshaft, the first throw, second throw and third throw sequentially arranged in an axial direction of the crankshaft, wherein the third throw of crankshaft has a turning direction substantially identical to the first throw of crankshaft and contrary to the second throw of crankshaft in the radial direction of the crankshaft; and a third primary connecting rod rotatably connected at one end with the third throw of crankshaft;

wherein:

the first primary connecting rod and the third primary connecting rod are coaxially rotatably connected at their respective opposite end with the swing arm of the first swing lever;

and the third throw of crankshaft is located on the same side of the crankshaft as the first throw of crankshaft, the first primary connecting rod, the third primary connecting rod, the first swing lever, the first secondary connecting rod, the first guide rail, the first slide yoke and the first ram, together constituting the first ram drive mechanism.

3. The dual-action can body maker according to claim 2, wherein the first primary connecting rod is substantially identical to the third primary connecting rod.

4. The dual double-action can body maker according to claim 1, wherein a rotation support point of the first swing lever and a rotation support point of the second swing lever are arranged in a cross-sectional plane of the crankshaft and symmetrically about a vertical line through a rotation central point of the crankshaft.

5. The dual double-action can body maker according to claim 1, wherein a rotation support point of the first swing lever and a rotation support point of the second swing lever are arranged in a cross-sectional plane of the crankshaft and symmetrically about a rotation central point of the crankshaft.

6. The dual-action can body maker according to claim 1, wherein the first primary connecting rod and the second primary connecting rod are configured substantially the same.

7. The dual action can body maker according to claim 1, wherein a rotation support point of the first swing lever and a rotation support point of the second swing lever are arranged in a common longitudinal cross-sectional plane extending radially outward from an axis of rotation of the crankshaft.

* * * * *